US006412302B1

(12) United States Patent
Foglietta

(10) Patent No.: US 6,412,302 B1
(45) Date of Patent: Jul. 2, 2002

(54) LNG PRODUCTION USING DUAL INDEPENDENT EXPANDER REFRIGERATION CYCLES

(75) Inventor: Jorge H. Foglietta, Missouri City, TX (US)

(73) Assignee: ABB Lummus Global, Inc. - Randall Division, Houston, TX (US)

( * ) Notice: Subject to any disclaimer, the term of this patent is extended or adjusted under 35 U.S.C. 154(b) by 0 days.

(21) Appl. No.: 09/828,551

(22) Filed: Apr. 6, 2001

Related U.S. Application Data

(60) Provisional application No. 60/273,531, filed on Mar. 6, 2001.

(51) Int. Cl.[7] ..... F25J 1/00; F25J 3/00

(52) U.S. Cl. ..... 62/611; 62/619

(58) Field of Search ..... 62/611, 612, 613, 62/614, 619, 912, 606

(56) References Cited

U.S. PATENT DOCUMENTS 4,057,972 A * 11/1977 Sarsten ..... 62/612
4,461,634 A * 7/1984 Duckett et al. ..... 62/611
4,755,200 A * 7/1988 Liu et al. ..... 62/612
4,911,741 A * 3/1990 Davis et al. ..... 62/613
5,036,671 A * 8/1991 Nelson et al. ..... 62/612
5,651,269 A * 7/1997 Prevost et al. ..... 62/613
5,755,114 A * 5/1998 Foglietta ..... 62/618
6,041,619 A * 3/2000 Fischer et al. ..... 62/612
6,105,389 A * 8/2000 Paradowski et al. ..... 62/613

* cited by examiner

*Primary Examiner*—William C. Doerrler
(74) *Attorney, Agent, or Firm*—Bracewell & Patterson LLP

(57) ABSTRACT

A process for producing a liquified natural gas stream that includes cooling at least a portion of a pressurized natural gas feed stream by heat exchange contact with first and second expanded refrigerants that are used in independent refrigeration cycles. The first expanded refrigerant is selected from methane, ethane and treated and pressurized natural gas. The second expanded refrigerant is nitrogen.

21 Claims, 4 Drawing Sheets

Production of LNG Using Dual Independent Expander Refrigeration Cycles

LNG PRODUCTION USING DUAL INDEPENDENT EXPANDER REFRIGERATION CYCLES

This application claims the benefits of provisional patent application, U.S. Ser. No. 60/273,531, filed on Mar. 6, 2001.

BACKGROUND OF THE INVENTION

1. Technical Field

This invention relates to a liquefaction process for a pressurized hydrocarbon stream using refrigeration cycles. More particularly, this invention relates to a liquefaction process for an inlet hydrocarbon gas stream using dual, independent refrigeration cycles having at least two different refrigerants.

2. Background of the Invention

Hydrocarbon gases, such as natural gas, are liquified to reduce their volume for easier transportation and storage. There are numerous prior art processes for gas liquefaction, most involving mechanical refrigeration or cooling cycles using one or more refrigerant gases.

U.S. Pat. Nos. 5,768,912 and 5,916,260 to Dubar disclose a process for producing a liquefied natural gas product where refrigeration duty is provided by a single nitrogen refrigerant stream. The refrigerant stream is divided into at least two separate streams which are cooled when expanded through separate turbo-expanders. The cooled, expanded nitrogen refrigerant cross-exchanged with a gas stream to produce liquified natural gas.

There is a need for simplified refrigeration cycles for the liquefaction of natural gas. Conventional liquefaction refrigeration cycles use refrigerants which undergo a change of phase during the refrigeration cycle which require specialized equipment for both liquid and gas refrigerant phases.

The invention disclosed herein meets these and other needs.

SUMMARY OF THE INVENTION

This invention is a cryogenic process for producing a liquified natural gas stream that includes the steps of cooling at least a portion of an inlet hydrocarbon gas feed stream by heat exchange contact with a first refrigeration cycle having a first expanded refrigerant and a second refrigeration cycle having a second expanded refrigerant that are operated in dual, independent refrigeration cycles. The first expanded refrigerant is selected from methane, ethane and other hydrocarbon gas, preferably treated inlet gas. The second expanded refrigerant is nitrogen. These dual, independent refrigerant cycles may be operated at the same time or operated independently.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

DETAILED DESCRIPTION OF PREFERRED EMBODIMENT

The present invention is directed to an improved process for the liquefaction of hydrocarbon gases, preferably a pressurized natural gas, which employs dual, independent refrigerant cycles having a first refrigeration cycle using an expanded nitrogen refrigerant and a second refrigeration cycle using a second expanded hydrocarbon. The second expanded hydrocarbon refrigerant may be pressurized methane or treated inlet gas.

As used herein, the term "inlet gas" will be taken to mean a hydrocarbon gas that is substantially comprised of methane, for example, 85% by volume methane, with the balance being ethane, higher hydrocarbons, nitrogen and other trace gases.

The detailed description of preferred embodiments of this invention is made with reference to the liquefaction of a pressurized inlet gas which has an initial pressure of about 800 psia at ambient temperature. Preferably, the inlet gas will have an initial pressure between about 500 to about 1200 psia at ambient temperature. As discussed herein, the expanding steps, preferably by isentropic expansion, may be effectuated with a turbo-expander, Joule-Thompson expansion valves, a liquid expander or the like. Also, the expanders may be linked to corresponding staged compression units to produce compression work by gas expansion.

Figure 1:
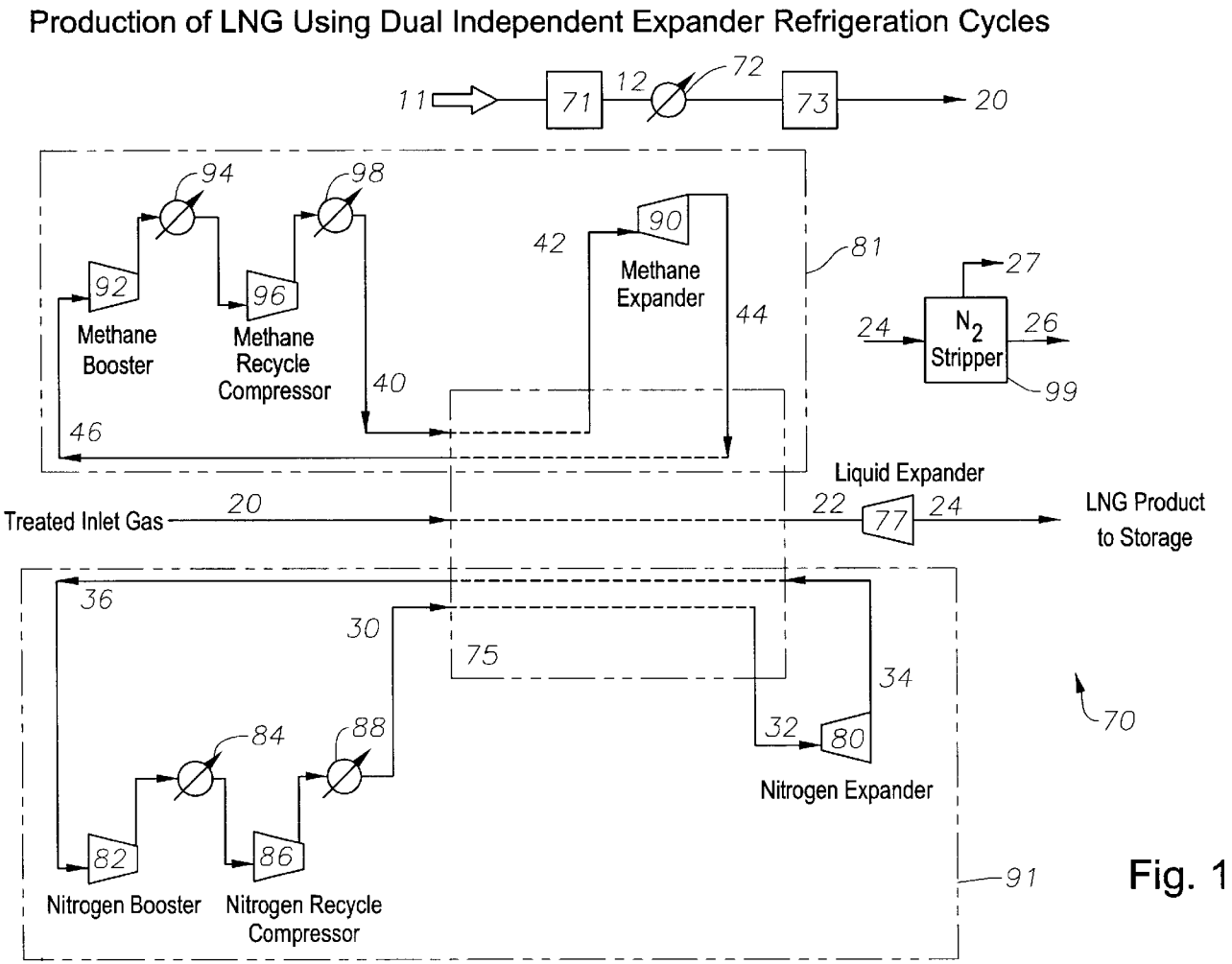
FIG. 1 is a simplified flow diagram of dual, independent expander refrigeration cycles operated in accordance with the present invention wherein a nitrogen stream and/or a methane stream are used as refrigerants

Referring now to FIG. 1 of the drawings, a pressurized inlet gas stream, preferably a pressurized natural gas stream, is introduced to the process of this invention. In the embodiment illustrated, the inlet gas stream is at a pressure of about 900 psia and ambient temperature. Inlet gas stream 11 is treated in a treatment unit 71 to removed acid gases, such as carbon dioxide, hydrogen sulfide, and the like, by known methods such as desiccation, amine extraction or the like. Also, the pretreatment unit 71 may serve as a dehydration unit of conventional design to remove water from the natural gas stream. In accordance with conventional practice in cryogenic processes, water may be removed from inlet gas streams to prevent freezing and plugging of the lines and heat exchangers at the low temperatures subsequently encountered in the process. Conventional dehydration units are used which include gas desiccants and molecular sieves.

Treated inlet gas stream 12 may be pre-cooled via one or more unit operations. Stream 12 may be pre-cooled via cooling water in cooler 72. Stream 12 may be further pre-cooled by a conventional mechanical refrigeration device 73 to form pre-cooled and treated stream 19 ready for liquefaction as treated inlet gas stream 20.

Treated inlet gas stream 20 is supplied to a refrigeration section 70 of a liquid natural gas manufacturing facility. Stream 20 is cooled and liquefied in exchanger 75 by countercurrent heat exchange contact with a first refrigeration cycle 81 and a second refrigeration cycle 91. These refrigeration cycles are designed to be operated independently and/or concurrently depending upon the refrigeration duty required to liquify an inlet gas stream.

In a preferred embodiment, a first refrigeration cycle 81 uses an expanded methane refrigerant and a second refrigeration cycle 91 uses an expanded nitrogen refrigerant. In the first refrigeration cycle 81, expanded methane is used as a refrigerant. A cold, expanded methane stream 44 enters exchanger 75, preferably at about −119° F. and about 200 psia and is cross-exchanged with treated inlet gas 20 and compressed methane stream 40. Methane stream 44 is warmed in exchanger 75 and then enters one or more compression stages as stream 46. Warm methane stream 46 is partially compressed in a first compression stage in methane booster compressor 92. Next, stream 46 is then compressed again in a second compression stage in methane recycle compressor 96 to a pressure from about 500 to 1400 psia. Stream 46 is water cooled in exchangers 94 and 98 and enters exchanger 75 as compressed methane stream 40. Stream 40 enters exchanger 75 at about 90° F. and preferably about 1185 psia. Stream 40 is cooled to about 20° F. and about 995 psia by cross-exchange with cold, expanded methane stream 44 and exits exchanger 75 as cooled methane stream 42. Stream 42 is preferably isentropically expanded in expander 90, to about −110 to −130° F., preferably to about −119° F. and about 200 psia. Stream 42 enters exchanger 75 as cold, expanded methane stream 44.

In the second refrigeration cycle 91, a cold, expanded nitrogen stream 34 enters exchanger 75 at preferably about −260° F. and about 200 psia and is cross-exchanged with treated inlet gas stream 20 and compressed nitrogen stream 30. Nitrogen stream 34 is warmed in exchanger 75 and then enters one or more compression steps as stream 36. Warm nitrogen stream 36 is partially compressed in nitrogen booster compressor 82 and then compressed again in nitrogen recycle compressor 86 to a pressure from about 500 to 1200 psia. Stream 36 is water cooled in exchangers 84 and 88 and enters exchanger 75 as compressed nitrogen stream 30. Stream 30 enters exchanger 75 at about 90° F. and preferably about 1185 psia. Stream 30 is cooled to preferably about −130° F. and about 1180 psia by cross-exchange with cold, expanded nitrogen stream 34 and exits exchanger 75 as cooled nitrogen stream 32. Stream 32 is preferably isentropically expanded in expander 80 to about −250 to −280° F., preferably to about −260° F. and about 200 psia. Stream 32 enters exchanger 75 as cold, expanded nitrogen stream 34.

The first and second dual, independent refrigeration cycles work independently to cool and liquefy inlet gas stream 20 from about −240 to −260° F., preferably to about 255° F. Liquified gas stream 22 is preferably isentropically expanded in expander 77 to a pressure from about 15 to 50 psia, preferably to about 20 psia to produce a liquified gas product stream 24.

Product stream 24 may contain nitrogen and other trace gases. To remove these unwanted gases, stream 24 is introduced to a nitrogen removal unit 99, such as a nitrogen stripper, to produce a treated product stream 26 and a nitrogen rich gas 27. Rich gas 27 may be used for low pressure fuel gas or recompressed and recycled with the inlet gas stream 11.

Figure 2:
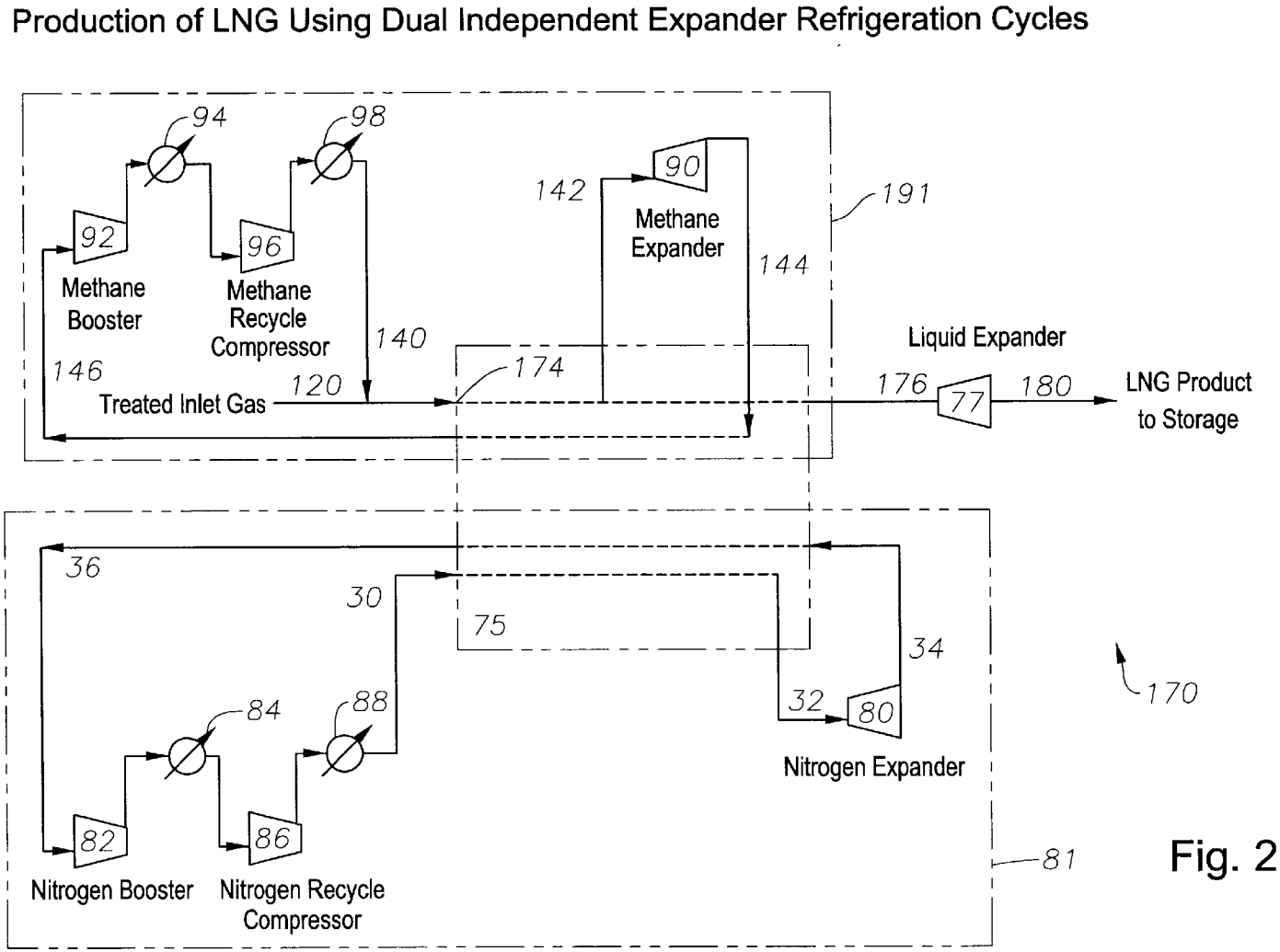
FIG. 2 is a simplified flow diagram of an another embodiment of the invention of FIG. 1 wherein a nitrogen stream and/or an inlet gas stream are used as refrigerants.

In another preferred embodiment, treated inlet gas may be used to supply at least a portion of refrigeration duty required by the process. As shown in FIG. 2, the first refrigeration cycle 191 uses an expanded hydrocarbon gas mixture as a refrigerant. The hydrocarbon gas mixture refrigerant is selected from methane, ethane and inlet gas. The second refrigeration cycle operates as discussed above.

In the first refrigeration cycle 191, cold expanded hydrocarbon gas mixture 144 enters exchanger 75 at preferably about −119° F. and 200 psia and is cross-exchanged with an inlet gas mixture 174 to be liquified. Gas mixture stream 144 is warmed in exchanger 75 and then enters one or more compression stages as stream 146. Warm gas mixture stream 146 is partially compressed in a first compression stage in methane booster compressor 92. Stream 146 is then compressed again in a second compression stage in methane recycle compressor 96 to a pressure from about 500 to 1400 psia. Stream 146 is water cooled in exchangers 94 and 98 as compressed gas mixture stream 140. Preferably, treated inlet gas 120 is mixed with compressed gas mixture 140 to form stream 174 to be liquified. Also, treated inlet gas 120 may be mixed with stream 146 prior to entering one or more compression stages. Stream 174 enters exchanger 75 at preferably about 90° F. and about 1000 psia. Stream 174 is cooled to preferably about 20° F. and about 995 psia by cross-exchange with cold, expanded gas mixture stream 144 and exits exchanger 75 as cooled gas mixture stream 142. Stream 142 is preferably isentropically expanded in expander 90 to about −110 to −130° F., preferably to about −119° F. and about 200 psia. Stram 142 enters exchanger 75 as cold, expanded gas mixture stream 144.

The first and/or second dual, independent refrigeration cycles work indpendently to cool and liquify inlet gas mixture 174 from about −240 to −260° F., preferably to about −255° F. Liquified gas mixture stream 176 is preferably isentropically expanded in expander 77 to a pressure from about 15 to 50 psia, preferably to about 20 psia to produce a liquified gas mixture product stream 180.

As noted above, the refrigerant gases in each dual, independent refrigerant cycle may be sent to their respective booster compressors and/or recycle compressors to recompress the refrigerant. The booster compressors and/or recycle compressors may be driven by a corresponding or operably linked turbo-expander in the process. In addition, the booster compressor may be operated in post-boost mode and located downstream from the recycle compressor to supply additional compression of about 50 to 100 psia to the refrigerant gases. The booster compressor may also be operated as pre-boosted mode and located upstream from the recycle compressor to partially compress the refrigerant gases about 50 to 100 psia before being sent to the final recycle compressors.

Figure 3:
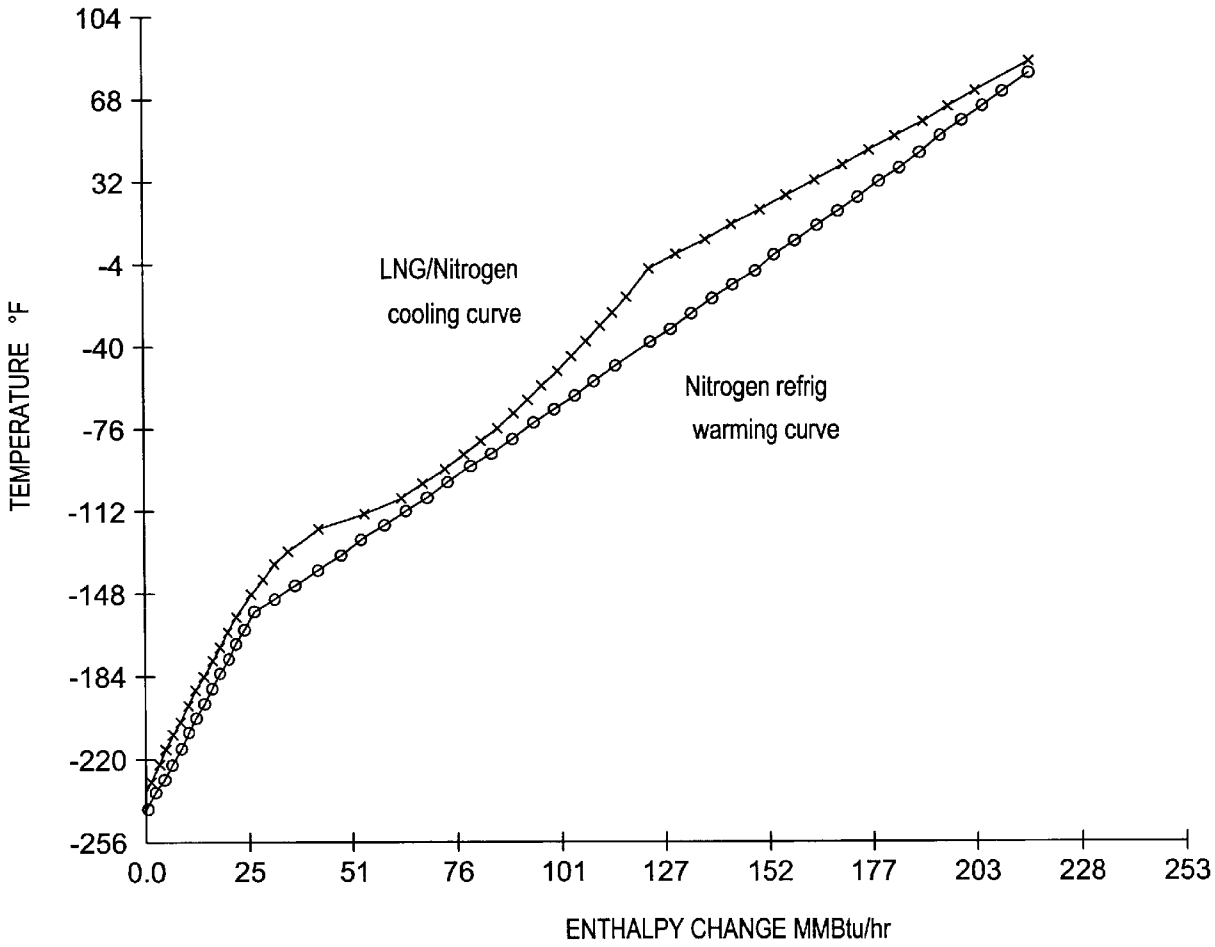
Fig. 3 (Prior Art)
FIG. 3 is a plot of a comparison of a nitrogen warming curve and a LNG/Nitrogen cooling curves for a prior art process.

FIG. 3 illustrates warming and cooling curves for a prior art liquefaction process.

The warming curve of the nitrogen refrigerant is essentially a straight line having a slope which is adjusted by varying the circulation rate of nitrogen refrigerant until a close approximation is achieved between the warming curve of the nitrogen refrigerant and the cooling curve of the feed gas at the warm end of the exchanger. This sets the upper limit of operation of the liquefaction process. Thus, by using this prior art method it is possible to obtain relatively close approximations at both the warm and cold ends of the heat exchanger between the different curves. However, because of the different shapes of the respective curves in the intermediate portion of each it is not possible to maintain a close approximation between the two curves over the entire temperature range of the process, i.e. the two curves diverge from each other in their intermediate portions. Although the nitrogen refrigerant warming curve approximates a straight line, the cooling curve of the feed gas and nitrogen is of a complex shape and diverges markedly from the linear warming curve of the nitrogen refrigerant. The divergence between the linear warming curve and the complex cooling curve is a measure of and represents thermodynamic inefficiencies or lost work in operating the overall process. Such inefficiencies or lost work are partly responsible for the higher power consumption of using the nitrogen refrigerant cycle compared to other processes such as the mixed refrigerant cycle.

Figure 4:
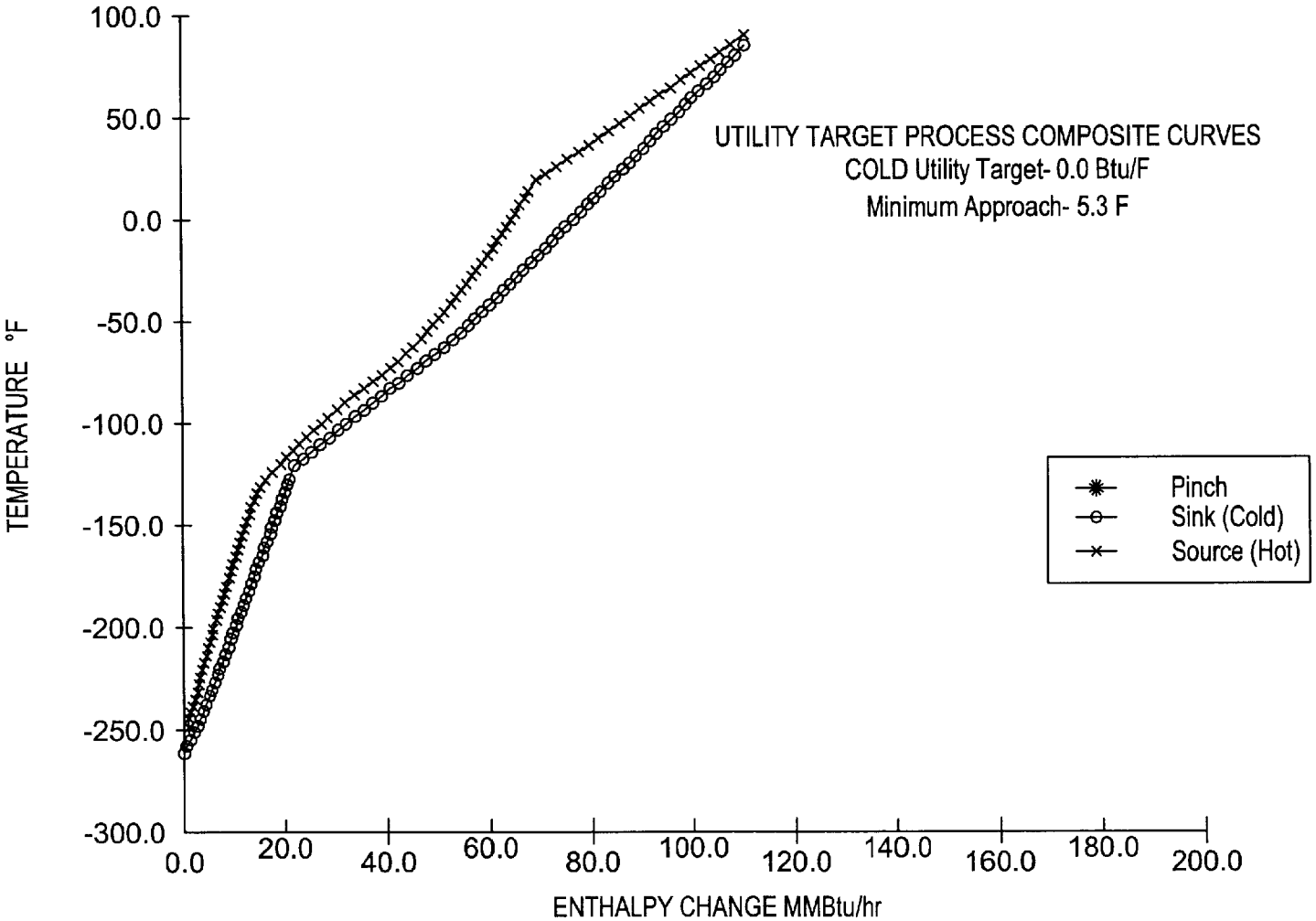
FIG. 4 is a plot of a comparison of a refrigerant warming curve and a LNG/nitrogen/methane cooling curve for the present invention.

FIG. 4 illustrates a warming and cooling curves for a preferred embodiment of this invention. This invention demonstrates improved thermodynamic efficiency or reduced lost work as compared to prior art gas liquefaction processes by utilizing the cooling capacity upon expansion of a hydrocarbon gas mixture, such as high pressure methane, ethane and/or inlet gas. In addition, thermodynamic efficiency is also improved over prior art processes because the dual, independent refrigeration cycles of the invention may be adjust and/or adapt to the particular refrigeration duty needed to liquefy a given inlet gas stream of known pressure, temperature and composition. That is, there is no need to supply more refrigeration duty that is required. As a result, the warming and cooling curves are more closely matched so that the temperature gradients and hence thermodynamic losses between the refrigerant and inlet gas stream are reduced.

In the process illustrated in FIG. 1, the warming curve is divided into two discrete sections by splitting the refrigeration duty required to liquefy the inlet gas into two refrigeration cycles. In the first cycle, a hydrocarbon gas mixture, such as methane refrigerant is expanded, preferably in a turbo-expander, to a lower pressure at a lower temperature and provides cooling of the inlet gas stream. The second cycle is used where a nitrogen refrigerant is expanded, preferably in a turbo-expander, to a lower pressure and temperature and provides further cooling of the gas stream. The flow rate of the refrigeration in the second cycle is chosen so that the slope of the warming curve is approximately the same as that of the cooling curve. Because of the shape and slope of the cooling curves in the last portion of the cooling process, it is the nitrogen cycle that provides the major portion of the refrigeration duty in this invention. As a result, the minimum temperature approach of approximately 5° F. is achieved throughout the exchanger.

The invention has significant advantages. First, the process is adaptable to different quality of the feed inlet gas by adjusting the relationship between the nitrogen and/or gas refrigerants and thereby more thermodynamically efficient. Second, the circulating refrigerants are in the gaseous phase. This eliminates the need for liquid separators or liquid storage and the concomitant environmental safety impacts. Gas phase refrigerants simplify the heat exchanger construction and design.

While the present invention has been described and/or illustrated with particular reference to the process for the liquefaction of hydrocarbons, such as natural gas, in which nitrogen and a second refrigerant, such as methane or other hydrocarbon gas, is used as refrigerants in dual, independent cycles, it is noted that the scope of the present invention is not restricted to the embodiment(s) described. It should be apparent to those skilled in the art that the scope of the invention includes other methods and applications of the process using nitrogen and/or to the use of other gases in the improved application or in other applications than those specifically described. Moreover, those skilled in the art will appreciate that the invention described above is susceptible to variations and modifications other than those specifically described. It is understood that the present invention includes all such variations and modifications which are within the spirit and scope of the invention. It is intended that the scope of the invention not be limited by the specification, but be defined by the claims set forth below.

It is claimed:

1. A process for producing a liquefied natural gas stream from an inlet gas feed stream, the process comprising the steps of:

cooling at least a portion of the inlet gas feed stream by heat exchange contact with first and second expanded refrigerants, wherein at least one of the first and second expanded refrigerants is circulated in a gas phase refrigeration cycle, whereby a liquefied natural gas stream is produced.

2. The process of claim 1 wherein the first expanded refrigerant is selected from the group consisting of methane, ethane and inlet gas.

3. The process of claim 1 wherein the second expanded refrigerant is nitrogen.

4. The process for producing a liquified natural gas stream of claim 1 wherein the first and second expanded refrigerants are expanded in a device selected from the group consisting of an expansion valve, a turbo-expander and a liquid expander.

5. The process of claim 1 wherein the liquefied natural gas stream is cooled to a temperature of about −240° F. to about −260° F.

6. The process of claim 1 wherein the inlet gas stream is at an inlet pressure of about 500 psia to about 1200 psia.

7. The process of claim 1 wherein a cooling curve for the first and second refrigerants approaches a cooling curve for the inlet gas feed stream by at least about 5° F.

8. The process of claim 1 wherein the cooling step includes cooling at least a portion of the inlet gas feed stream with a mechanical refrigeration cycle.

9. The process of claim 8 wherein the mechanical refrigeration cycle includes a refrigerant selected from the group consisting of propane and propylene.

10. The process of claim 1 or 8 wherein the cooling step includes cooling at least a portion of the inlet gas feed stream with cooling water.

11. A process for producing a liquified natural gas stream from a inlet gas feed stream, the process comprising the steps of:

cooling at least a portion of the inlet gas feed stream by heat exchange contact with a first refrigeration cycle operated independently of a nitrogen refrigeration cycle;

the first refrigeration cycle comprising the steps of:

expanding a refrigerant stream to form a cold refrigerant vapor stream;

cooling at least a portion of the inlet feed gas stream by heat exchange contact with the cold refrigerant vapor stream;

compressing the cold refrigerant vapor stream to form a compressed refrigerant vapor stream; and cooling at least a portion of the compressed refrigerant vapor stream by heat exchange contact with the cold refrigerant vapor stream; and the nitrogen refrigeration cycle comprising the steps of:

expanding a nitrogen stream to a cold nitrogen vapor stream;

cooling at least a portion of the inlet feed gas stream by heat exchange contact with the cold nitrogen vapor stream;

compressing the cold nitrogen vapor stream to form a compressed nitrogen vapor stream; and cooling at least a portion of the compressed nitrogen vapor stream by heat exchange contact with the cold nitrogen vapor stream;

whereby a liquified natural gas stream is produced.

12. The process for producing a liquified natural gas stream of claim 11 wherein the refrigerant stream in the first refrigeration cycle is selected from the group consisting of methane, ethane and inlet gas.

13. The process for producing a liquified inlet gas stream of claim 12 wherein the compressing step of the first refrigeration cycle includes mixing at least a portion of the inlet gas feed stream with the compressed refrigerant vapor stream to form the refrigerant stream.

14. The process for producing a liquified natural gas stream of claim 13 wherein the expanding step of the first refrigeration cycle includes expanding the refrigerant stream to a temperature of about −110° F. to about −130° F.

15. The process for producing a liquified natural gas stream of claim 11 wherein the expanding step of the nitrogen refrigeration cycle includes expanding the nitrogen stream to a temperature of about −250° F. to about −280° F.

16. The process for producing a liquified natural gas stream of claim 11 wherein the expanding step in the first and nitrogen refrigeration cycles is provided by an expansion device selected from the group consisting of an expansion valve, a turbo-expander and a liquid expander.

17. The process for producing a liquified natural gas stream of claim 11 wherein the compressed nitrogen vapor stream of the nitrogen refrigeration cycle is compressed to a pressure of about 500 psia to about 1200 psia.

18. The process for producing a liquified natural gas stream of claim 11 wherein the compressed refrigerant vapor stream of the first refrigerant cycle is compressed to a pressure of about 500 psia to about 1400 psia.

19. The process for producing a liquified natural gas stream of claims 1 or 11 further comprising the step of removing nitrogen and other trace gases from the liquified natural gas stream.

20.The process of claims 1 or 11 further comprising the step of expanding the liquified natural gas stream to a pressure from about 15 psia to about 50 psia.

21. The process of claim 1 wherein the cooling at least a portion of the inlet feed stream is performed by heat exchange contact with at least one of the gas phase refrigeration cycles.

* * * * *